US005834664A

United States Patent [19]

Aonuma et al.

[11] Patent Number: 5,834,664

[45] Date of Patent: Nov. 10, 1998

[54] WEAR-RESISTANT SINTERED ALLOY, AND ITS PRODUCTION METHOD

[75] Inventors: Koichi Aonuma; Yoshimasa Aoki; Koichiro Hayashi, all of Matsudo, Japan

[73] Assignee: Hitachi Powdered Metals Co., Ltd., Chiba Prefecture, Japan

[21] Appl. No.: 779,524

[22] Filed: Jan. 7, 1997

[30] Foreign Application Priority Data

Jan. 19, 1996 [JP] Japan ..... 8-024889

[51] Int. Cl.[6] ..... B22F 9/00

[52] U.S. Cl. ..... 75/246; 75/231; 75/243; 419/27; 419/38

[58] Field of Search ..... 75/246, 243, 231; 419/38, 27

[56] References Cited

U.S. PATENT DOCUMENTS

| | | | |
|---|---|---|---|
| 4,724,000 | 2/1988 | Larson et al. | 75/236 |
| 4,863,513 | 9/1989 | Umeha et al. | 75/231 |
| 4,919,719 | 4/1990 | Abe et al. | 75/243 |
| 5,049,183 | 9/1991 | Saka et al. | 75/244 |
| 5,498,483 | 3/1996 | Ito et al. | 428/552 |
| 5,529,602 | 6/1996 | Ishii et al. | 75/231 |

FOREIGN PATENT DOCUMENTS

| | | |
|---|---|---|
| 40 31 408 | 4/1991 | Germany . |
| 55-36242 | 9/1980 | Japan . |
| 62-10244 | 1/1987 | Japan . |
| 2-111848 | 4/1990 | Japan . |
| 7-233454 | 9/1995 | Japan . |

*Primary Examiner*—Ngoclan Mai
*Attorney, Agent, or Firm*—Evenson, McKeown, Edwards & Lenahan P.L.L.C.

[57] ABSTRACT

The present invention provides a valve seat having a suitable degree of wear resistance, which can be produced without recourse to expensive elements represented by cobalt and at a cost lower than ever before. This valve seat is formed of a wear-resistant sintered alloy having a general composition consisting essentially of, in weight ratio, 0.736 to 5.79% of nickel, 0.12 to 6.25% of chromium, 0.294 to 0.965% of molybdenum, and 0.508 to 2.0% of carbon with the balance being iron, and inevitable impurities, and having a micro structure wherein a bainite matrix structure or a mixed bainite and sorbite matrix structure includes a nucleus having a hard phase composed mainly of chromium carbide, and a ferrite surrounding said nucleus and having a high chromium concentration and a martensite surrounding said ferrite are dispersed.

18 Claims, 8 Drawing Sheets

WEAR-RESISTANT SINTERED ALLOY, AND ITS PRODUCTION METHOD

BACKGROUND OF THE INVENTION

The present invention relates to a wear-resistant sintered alloy best suited for valve seats in internal combustion engines in particular.

To accommodate to high-performance, and high-output engines for automobiles, sintered alloys for valve seats are now required to have wear resistance and strength at high temperatures. Applicants, too, have developed a valve seat sintered alloy (Japanese Patent Publication No. 36242/1980) produced by the production method registered under U.S. Pat. No. 1,043,124. Furthermore in Japanese Patent laid-Open No. 10244/1987, Japanese Patent Laid-Open No. 233454/1995 and so on, applicants have put forward sintered alloys much more improved in terms of wear resistance and strength at high temperatures so as to meet recent demands toward much more enhanced performance and output, especially elevated combustion temperatures at low air fuel ratios. However, these materials cost much because large amounts of expensive elements such as cobalt are incorporated in a matrix component to make improvements in performance at high temperatures.

Recently developed, more sophisticated engine design technology, however, enables materials other than high-performance yet costly materials such as those set forth in the aforesaid Japanese Patent Laid-Open No. 10244/1987 and Japanese Patent Laid-Open No. 233454/1995 to be utilized for valve seats. In particular, valve seats located on an intake side are lower than those located on an exhaust side in terms of the environmental temperature at which they are used, and so the use of materials such as those described in the aforesaid Japanese Patent Laid-Open No. 10244/1987 and Japanese Patent Laid-Open No. 233454/1995 for such valve seats become unreasonable in view of quality. On the other hand, recent trends in the development of automobiles are shifting from automobiles attaching much importance to performance to those imposing much weight to high cost-performance or economical considerations. Thus, inexpensive sintered alloys having a moderate degree of wear resistance, rather than those having excessive wear resistance, are now required for future valve seat sintered alloys.

It is therefore an object of the present invention to meet the aforesaid requirement by providing a valve seat or other like element having a reasonable degree of wear resistance without recourse to any costly element such as cobalt and, hence, at a cost lower than ever before.

SUMMARY OF THE INVENTION

To achieve the aforesaid object, according to a first aspect of the present invention there is provided a wear-resistant sintered alloy having a general composition consisting essentially of, in weight ratio, 0.736 to 5.79% of nickel, 0.12 to 6.25% of chromium, 0.294 to 0.965% of molybdenum, and 0.508 to 2.0% of carbon with the balance being iron, and inevitable impurities, and having a micro structure wherein a bainite matrix structure or a mixed bainite and sorbite matrix structure includes a nucleus having a hard phase composed mainly of chromium carbide, and a ferrite surrounding said nucleus and having a high chromium concentration and a martensite surrounding said ferrite are dispersed.

According to a second aspect of the present invention, there is provided a wear-resistant sintered alloy having a general composition consisting essentially of, in weight ratio, 0.736 to 5.79% of nickel, 0.12 to 6.25% of chromium, 0.303 to 1.715% of molybdenum, and 0.508 to 2.0% of carbon with the balance being iron, and inevitable impurities, and having a micro structure wherein a bainite matrix structure or a mixed bainite and sorbite matrix structure includes a nucleus having a hard phase composed mainly of chromium carbide, and a ferrite surrounding said nucleus and having a high chromium concentration and a martensite surrounding said ferrite are dispersed.

According to a third aspect of the present invention, there is provided a wear-resistant sintered alloy having a general composition consisting essentially of, in weight ratio, 0.736 to 5.79% of nickel, 0.12 to 6.25% of chromium, 0.303 to 1.715% of molybdenum, 0.508 to 2.0% of carbon, and 0.006 to 0.55% of vanadium and/or 0.03 to 1.25% of tungsten with the balance being iron, and inevitable impurities, and having a micro structure wherein a bainite matrix structure or a mixed bainite and sorbite matrix structure includes a nucleus having a hard phase composed mainly of chromium carbide, and a ferrite surrounding said nucleus and having a high chromium concentration and a martensite surrounding said ferrite are dispersed.

According to a fourth aspect of the present invention, there is provided a wear-resistant sintered alloy wherein 0.1 to 2.0% by weight of manganese sulfide is homogeneously dispersed in the wear-resistant sintered alloy according to any one of the aforesaid first to third aspects of the present invention.

According to a fifth aspect of the present invention, there is provided a sintered alloy wherein any one of an acrylic resin, lead, and a lead alloy is dispersed into pores in the wear-resistant sintered alloy according to any one of the first to fourth aspects of the present invention.

The present invention provides a method of producing the sintered alloy according to the aforesaid first aspect wherein a powder mixture of 0.5 to 1.4% by weight of a graphite powder and 3 to 25% by weight of a hard phase-forming powder having a composition consisting essentially of, in weight ratio, 4.0 to 25% of chromium, and 0.25 to 2.4% of carbon with the balance being iron, and inevitable impurities is used with a matrix-forming alloy powder having a composition consisting essentially of, in weight ratio, 1 to 6% of nickel, and 0.4 to 1.0% of molybdenum with the balance being iron, and inevitable impurities.

The present invention provides a method of producing the sintered alloy according to the aforesaid second aspect wherein a powder mixture of 0.5 to 1.4% by weight of a graphite powder and 3 to 25% by weight of a hard phase-forming powder having a composition consisting essentially of, in weight ratio, 4.0 to 25% of chromium, 0.3 to 3.0% of molybdenum, and 0.25 to 2.4% of carbon with the balance being iron, and inevitable impurities is used with a matrix-forming alloy powder having a composition consisting essentially of, in weight ratio, 1 to 6% of nickel, and 0.4 to 1.0% of molybdenum with the balance being iron, and inevitable impurities.

The present invention provides a method of producing the sintered alloy according to the aforesaid third aspect wherein a powder mixture of 0.5 to 1.4% by weight of a graphite powder and 3 to 25% by weight of a hard phase-forming powder having a composition consisting essentially of, in weight ratio, 4.0 to 25% of chromium, 0.3 to 3.0% of molybdenum, 0.25 to 2.4% of carbon, and 0.2 to 2.2% of vanadium and/or 1.0 to 5.0% of tungsten with the balance being iron, and inevitable impurities is used with a matrix-forming alloy powder having a composition consisting essentially of, in weight ratio, 1 to 6% of nickel, and 0.4 to 1.0% of molybdenum with the balance being iron, and inevitable impurities.

The present invention provides a method of producing the sintered alloy according to the aforesaid fourth aspect wherein 0.1 to 2.0% by weight of a manganese sulfide powder is further mixed with the powder mixture used in any one of the production methods for the alloys according to the aforesaid first to third aspects.

The present invention provides a method of producing the sintered alloy according to the aforesaid fifth aspect wherein any one of an acrylic resin, lead, and a lead alloy is incorporated or impregnated into pores in a sintered body obtained by forming and sintering the powder mixture used in any one of the production methods for the aforesaid first to fourth aspects.

DETAILED EXPLANATION OF THE PREFERRED EMBODIMENTS

Figure 1:
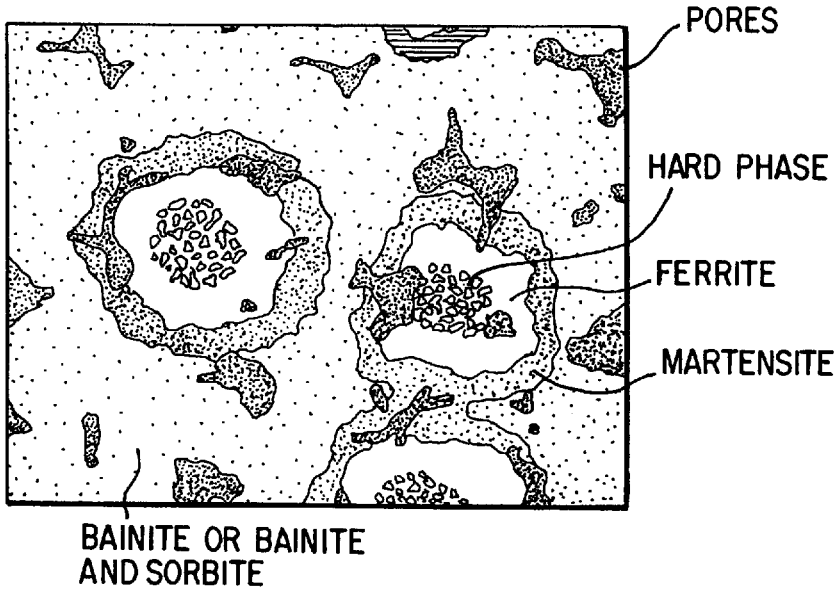
FIG. 1 is a schematic of one exemplary wear-resistant sintered alloy according to the present invention.

One exemplary micro structure of the sintered alloy according to the present invention is schematically shown in FIG. 1. The micro structure of the sintered alloy will now be explained with reference to the quantitative limitations imposed on the respective components.

Bainite structure is second in hardness and density to martensite structure, and so is effective for wear resistance, whereas sorbite is second in hardness and strength to bainite. This is the reason that the matrix to be used is made up of bainite or a mixed bainite and sorbite structure. To construct the matrix structure from bainite or a mixed bainite and sorbite structure, it is preferable to use an alloy powder as the starting powder. This is because when the alloy components are used in discrete powder forms or in the form of partially dispersed alloy powders where discrete alloy powders are partially dispersed and metallurgically bonded with one another, some difficulty is encountered in obtaining the end structure due to an increased segregation, and partial non-diffusion which occurs depending on the alloy component used.

By use of the structure consisting of bainite or the mixed bainite and sorbite structure alone, however, the achievable wear resistance becomes insufficient. To increase wear resistance, therefore, there is provided a phase having a hard-phase nucleus composed mainly of chromium carbide, in which a ferrite surrounding the nucleus and having a high chromium concentration, and a martensite surrounding the ferrite are dispersed. The hard phase composed mainly of chromium carbide has a pin anchorage effect on reducing the plastic flow of the matrix which occurs when a valve is contacted with a valve seat. The ferrite having a high chromium concentration, because it is a ferrite having high-alloy strength, acts as a shock absorber when a valve face comes into contact with the hard phase so that it is less likely to make an attack on the valve, and is effective for preventing hard particles from falling off. The martensite surrounding the ferrite is a hard structure having high strength, and so makes some considerable contribution to wear resistance.

The aforesaid structure, which includes a nucleus having a hard phase composed mainly of chromium carbide, and in which a ferrite surrounding said nucleus and having a high chromium concentration and a martensite surrounding said ferrite are dispersed, is provided by an iron-chromium type of hard phase-forming powder. In other words, the chromium in the hard phase-forming powder is bonded to the carbon upon sintering to precipitate out the chromium carbide, so that the hard phase can be formed. On the other hand, the chromium is diffused from the hard phase-forming powder into the matrix to enhance the hardenability of the matrix so that the martensite can be formed therearound while the ferrite having a high chromium concentration can be formed around the hard phase.

The hard phase-forming powder, if added in an amount 3% or less, fails to form a sufficient hard phase and so makes no contribution to improvements in wear resistance. At more than 25%, on the other hand, the proportion of the ferrite having a high chromium concentration increases, resulting in drops of hardness and wear resistance. In addition, there is an increase in the proportion of the hard phase-forming powder, which otherwise gives rise to a compressibility drop. moreover, if an alloy having a hard phase-forming powder content exceeding 25% is used to form a valve seat, that valve seat would cause an associated valve to wear away due to a vigorous attack thereon. Thus, the amount of the hard phase-forming powder added is limited to the range of 3 to 25%.

The nickel is provided to the matrix-forming alloy powder in the form of a perfect solid solution which makes a contribution to improvements in the hardenability of the matrix structure, thereby making the matrix bainitic and enhancing the strength and wear resistance of the matrix. However, when the nickel content of the matrix-forming alloy powder is 1% or less, it is impossible to achieve any sufficient increase in hardenablity. When the nickel is added in an amount exceeding 6%, on the other hand, it is found that the matrix-forming alloy powder becomes hard and poor in compressibility, resulting in a formed body of decreased density and causing matrix strength to drop to the contrary. Thus, the amount of the nickel in the matrix-forming alloy powder is limited to the range of 1 to 6%.

The molybdenum in the matrix-forming alloy powder is effective not only to enhance the hardenability of the matrix structure but also to increase the hardness and strength of the matrix at high temperature. However, it is found that the molybdenum, when added in an amount less than 0.4%, fails to produce the aforesaid effect sufficiently, and when added in an amount exceeding 1.0%, causes the compressibility of the powder to drop. Thus, the amount of the molybdenum in the matrix-forming alloy powder is limited to the range of 0.4 to 1.0%.

When the molybdenum is provided in the form of a solid solution to the hard phase-forming powder, it generates a fine form of molybdenum carbide in the hard phase, and forms an eutectic carbide with chromium, as will be described later, thereby making a contribution to improvements in wear resistance. A part of the element which does not form the carbide forms a solid solution with the hard phase to thereby enhance the hardness and strength of the hard phase at high temperature.

It is found that the molybdenum, when added to the hard phase-forming powder in an amount less than 0.3%, fails to produce the aforesaid effect sufficiently, and when added in an amount exceeding 3.0%, causes the amount of the carbide to increase (if an alloy containing molybdenum in too large an amount is used to make a valve seat, that valve seat would cause an associated valve to wear away due to a vigorous attack thereon). Thus, when the molybdenum is provided in the form of a solid solution to the hard phase-forming powder, it is preferable that the amount of the molybdenum is limited to the range of 0.3 to 3.0%.

In the hard phase-forming powder, the chromium reacts with carbon to generate chromium carbide in the hard phase, which is hard, and excellent in wear resistance as well. The chromium also forms an eutectic carbide with molybdenum, as will be described later, thereby making a contribution to wear resistance.

A part of the chromium is diffused from the hard phase-forming powder into the matrix to enhance the hardenability of the matrix, and to accelerate the martensitic or bainitic transformation of the matrix. The chromium, on the other hand, is a ferrite-stabilizing element which ensures that the phase surrounding the hard phase and having a high chromium concentration provides a ferrite phase without undergoing any martensitic transformation. Here, if the chromium content is less than 4.0%, no sufficient amount of the carbide is achievable, nor is any contribution made to improvements in wear resistance. In addition, no sufficient ferrite phase is formed around the hard phase due to a reduced amount of the chromium diffused. If an alloy containing chromium in too small an amount is used to make a valve seat, that valve seat would become poor in shock-absorbing effect upon an associated valve received thereon. If an alloy containing chromium in an amount exceeding 25% is used to make a valve seat, on the other hand, that valve seat would cause an associated valve to wear away due to an increased amount of the carbide and, hence, a vigorous attack thereon. In addition, more than 25% of chromium is found to cause a drop of the compressibility of the hard phase-forming powder. Thus, the chromium content is limited to the range of 4.0 to 25%.

In the hard phase-forming powder, the vanadium and tungsten react with the carbon added to generate a fine form of carbides in the hard phase, to thereby enhance the wear resistance of the hard phase. In addition, these carbides are homogeneously diffused into the hard phase to thereby prevent the coarsening of the chromium carbide.

It is here found that when the vanadium and tungsten contents are less than 0.2% and 1.0%, respectively, the aforesaid effect becomes slender. If an alloy containing vanadium and tungsten in amounts exceeding 2.2% and 5.0%, respectively, is used to make a valve seat, that valve seat would cause an associated valve to wear away due to an increased amount of the carbides and, hence, a vigorous attack thereon. Thus, the vanadium and tungsten contents are limited to the ranges of 0.2 to 2.2% and 1.0 to 5.0%, respectively.

The carbon is used for the purpose of reinforcing the matrix structure by martensitic or bainitic transformation, and precipitating out carbides in the hard phase.

The amount of the carbon to be contained in the hard phase-forming powder lies within the range of 0.25 to 2.4%. When the carbon content of the hard phase-forming powder is less than 0.25%, no sufficient amounts of carbides precipitate out, and when it exceeds 2.4%, the powder becomes hard, posing some problems such as a drop of compressibility.

When the amount of the carbon to be added as graphite powder for the purpose of reinforcing the matrix is less than 0.5%, the matrix structure undergoes neither martensitic transformation nor bainitic transformation. At a carbon content exceeding 1.4%, on the other hand, the matrix does not only tend to contain an unsaturated solid solution, resulting in drops of toughness and machinability, but is also likely to generate a liquid phase upon sintering, which otherwise causes dimensional accuracy and quality stability to become worse. Thus, the amount of the carbon to be added as graphite powder is limited to the range of 0.5 to 1.4%. The manganese sulfide or MnS is added to the raw materials upon blending to enhance machinability by diffusion into the matrix. When the amount of the manganese sulfide to be added is less than 0.1%, no effect upon the enhancement of machinability is achievable. At a manganese sulfide content exceeding 2.0%, on the other hand, compressibility drops, and sintering is inhibited, resulting in a drop of mechanical properties upon sintering. From these reasons, the amount of the manganese sulfide to be added is limited to the range of 0.1 to 2.0%.

The acrylic resin, lead, or a lead alloy remains incorporated in pores in a sintered alloy to ensure that the sintered alloy can be cut continuously rather than intermittently to absorb shocks on a cutting edge of tool during cutting, thereby preventing any possible damage to the tool blade and so improving the machinability of the sintered alloy.

The lead or lead alloy, because of being soft by nature, can be deposited onto the tool face so that the cutting edge of tool can be protected against any possible damage to thereby improve the machinability of the sintered alloy and increase the service life of the tool. In addition, the lead or lead alloy acts as a solid lubricant between a valve seat and a valve face to thereby reduce the wearing of both the members.

EXAMPLES

The present invention will now be explained at great length with reference to a number of examples. In these examples, matrix-forming alloy powders (powder Nos. 1–8) having the compositions shown in Table 1, hard phase-forming powders (powder Nos. 1–24) having the compositions shown in Table 2, graphite powders, MnS powders, and a forming lubricant (zinc stearate) were blended together at the proportions shown in Tables 3 and 4. Each of the thus obtained blends was mixed for 30 minutes, followed by forming at a forming pressure of 6.5 ton/cm$^2$.

Then, the formed bodies are each sintered at 1,175° C. for 60 minutes in a dissociated ammonia gas to obtain inventive alloys 1–39 (sample Nos. 1–39) reported in Table 6, and comparative alloys (sample Nos. 1–11) reported in Table 7.

It is understood that pores in inventive alloys 14 and 15 were impregnated with acrylic resin, and lead after sintering.

Of the comparative alloys, comparative alloys 1–11 are alloys having any one of their components departing from the present invention, comparative alloy No. 12 is an alloy in which the matrix-forming alloy powders are provided in discrete powder form, and comparative alloy 13 is an alloy obtained by treating the alloy set forth in U.S. Pat. No. 1,043,124 under the same conditions.

Set out in Table 1 are the matrix-forming alloy powders used.

TABLE 1

| Matrix-Forming Alloy Powders | | | | |
|---|---|---|---|---|
| Powder | Components (wt. %) | | | |
| No. | Fe | Ni | Mo | Remarks |
| 1 | 98.5 | 1.0 | 0.5 | Ni — lower limit |
| 2 | 97.5 | 2.0 | 0.5 | |
| 3 | 96.5 | 3.0 | 0.5 | |
| 4 | 95.5 | 4.0 | 0.5 | |
| 5 | 94.5 | 5.0 | 0.5 | Ni — upper limit |
| 6 | 93.5 | 6.0 | 0.5 | Ni — below lower limit |
| 7 | 99.5 | | 0.5 | Ni — above upper limit |
| 8 | 92.5 | 7.0 | 0.5 | |

Set out in Table 2 are the hard phase-forming powders used.

TABLE 2

| Hard Phase-Forming Powders | | | | | | | |
|---|---|---|---|---|---|---|---|
| Powder No. | Components wt. % | | | | | | Remarks |
| | Fe | Cr | Mo | V | W | C | |
| 1 | 93.1 | 4.0 | 1.0 | 0.5 | | 1.4 | Cr-lower limit |
| 2 | 92.1 | 5.0 | 1.0 | 0.5 | | 1.4 | |
| 3 | 89.1 | 8.0 | 1.0 | 0.5 | | 1.4 | |
| 4 | 86.6 | 12.0 | | | | 1.4 | |
| 5 | 86.3 | 12.0 | 0.3 | | | 1.4 | Mo-lower limit |
| 6 | 86.0 | 12.0 | 0.6 | | | 1.4 | |
| 7 | 85.6 | 12.0 | 1.0 | | | 1.4 | |
| 8 | 85.4 | 12.0 | 1.0 | 0.2 | | 1.4 | |
| 9 | 85.1 | 12.0 | 1.0 | 0.5 | | 1.4 | |
| 10 | 83.1 | 12.0 | 1.0 | 0.5 | 2.0 | 1.4 | |
| 11 | 84.6 | 12.0 | 1.0 | 1.0 | | 1.4 | |
| 12 | 84.1 | 12.0 | 1.0 | 1.5 | | 1.4 | |
| 13 | 83.6 | 12.0 | 1.0 | 2.0 | | 1.4 | |
| 14 | 83.4 | 12.0 | 1.0 | 2.2 | | 1.4 | V-upper limit |
| 15 | 84.6 | 12.0 | 2.0 | | | 1.4 | |
| 16 | 83.6 | 12.0 | 3.0 | | | 1.4 | Mo-upper limit |
| 17 | 82.1 | 15.0 | 1.0 | 0.5 | | 1.4 | |
| 18 | 77.1 | 20.0 | 1.0 | 0.5 | | 1.4 | |
| 19 | 74.1 | 23.0 | 1.0 | 0.5 | | 1.4 | |
| 20 | 72.1 | 25.0 | 1.0 | 0.5 | | 1.4 | Cr-upper limit |
| 21 | 95.1 | 2.0 | 1.0 | 0.5 | | 1.4 | Cr-below lower limit |
| 22 | 71.1 | 26.0 | 1.0 | 0.5 | | 1.4 | Cr-above upper limit |
| 23 | 83.2 | 12.0 | 3.4 | | | 1.4 | Mo-above upper limit |
| 24 | 83.1 | 12.0 | 1.0 | 2.5 | | 1.4 | V-above upper limit |

Set out in Table 3 are the components (% by weight) of alloys according to the present invention.

TABLE 3

| | Components in % by weight | | | | | | | | |
|---|---|---|---|---|---|---|---|---|---|
| | Matrix-forming alloy powder | | Hard phase-forming powders | | Amount of graphite added wt. % | Amount of MnS powders added wt. % | Amount of forming lubricant added wt. % | Impregna-tion/ infiltra-tion | Remarks |
| A No. | Powder Nos. | Wt. % | Powder Nos. | Wt. % | | | | | |
| 1 | 1 | 89.0 | 10 | 10.0 | 1.0 | | 0.5 | | Remarks 1 |
| 2 | 2 | 96.0 | 10 | 3.0 | 1.0 | | 0.5 | | Remarks 2 |
| 3 | 2 | 89.0 | 1 | 10.0 | 1.0 | | 0.5 | | Remarks 3 |
| 4 | 2 | 89.0 | 2 | 10.0 | 1.0 | | 0.5 | | |
| 5 | 2 | 89.0 | 3 | 10.0 | 1.0 | | 0.5 | | |
| 6 | 2 | 89.0 | 4 | 10.0 | 1.0 | | 0.5 | | |
| 7 | 2 | 89.0 | 5 | 10.0 | 1.0 | | 0.5 | | Remarks 4 |
| 8 | 2 | 89.0 | 6 | 10.0 | 1.0 | | 0.5 | | |
| 9 | 2 | 89.0 | 7 | 10.0 | 1.0 | | 0.5 | | |
| 10 | 2 | 89.0 | 8 | 10.0 | 1.0 | | 0.5 | | |
| 11 | 2 | 89.5 | 9 | 10.0 | 0.5 | | 0.5 | | Remarks 5 |
| 12 | 2 | 89.2 | 9 | 10.0 | 0.8 | | 0.5 | | |
| 13 | 2 | 89.0 | 9 | 10.0 | 1.0 | | 0.5 | | |
| 14 | 2 | 89.0 | 9 | 10.0 | 1.0 | | 0.5 | Acrylic | Remarks 6 |
| 15 | 2 | 89.0 | 9 | 10.0 | 1.0 | | 0.5 | Pb | Remarks 7 |
| 16 | 2 | 88.8 | 9 | 10.0 | 1.0 | 0.2 | 0.5 | | |
| 17 | 2 | 88.2 | 9 | 10.0 | 1.0 | 0.8 | 0.5 | | |
| 18 | 2 | 87.6 | 9 | 10.0 | 1.0 | 1.4 | 0.5 | | |
| 19 | 2 | 87.0 | 9 | 10.0 | 1.0 | 2.0 | 0.5 | | Remarks 8 |
| 20 | 2 | 88.8 | 9 | 10.0 | 1.2 | | 0.5 | | |
| 21 | 2 | 88.6 | 9 | 10.0 | 1.4 | | 0.5 | | Remarks 9 |
| 22 | 2 | 89.0 | 10 | 10.0 | 1.0 | | 0.5 | | |
| 23 | 2 | 89.0 | 11 | 10.0 | 1.0 | | 0.5 | | |
| 24 | 2 | 89.0 | 12 | 10.0 | 1.0 | | 0.5 | | |
| 25 | 2 | 89.0 | 13 | 10.0 | 1.0 | | 0.5 | | |

-continued

| | | | | | | | | | |
|---|---|---|---|---|---|---|---|---|---|
| 26 | 2 | 89.0 | 14 | 10.0 | 1.0 | | 0.5 | | Remarks 10 |
| 27 | 2 | 89.0 | 15 | 10.0 | 1.0 | | 0.5 | | |
| 28 | 2 | 89.0 | 16 | 10.0 | 1.0 | | 0.5 | | Remarks 11 |
| 29 | 2 | 89.0 | 17 | 10.0 | 1.0 | | 0.5 | | |
| 30 | 2 | 89.0 | 18 | 10.0 | 1.0 | | 0.5 | | |
| 31 | 2 | 89.0 | 19 | 10.0 | 1.0 | | 0.5 | | |
| 32 | 2 | 89.0 | 20 | 10.0 | 1.0 | | 0.5 | | Remarks 12 |
| 33 | 2 | 84.0 | 9 | 15.0 | 1.0 | | 0.5 | | |
| 34 | 2 | 79.0 | 9 | 20.0 | 1.0 | | 0.5 | | |
| 35 | 2 | 74.0 | 9 | 25.0 | 1.0 | | 0.5 | | Remarks 13 |
| 36 | 3 | 89.0 | 9 | 10.0 | 1.0 | | 0.5 | | |
| 37 | 4 | 89.0 | 9 | 10.0 | 1.0 | | 0.5 | | |
| 38 | 5 | 89.0 | 9 | 10.0 | 1.0 | | 0.5 | | |
| 39 | 6 | 89.0 | 9 | 10.0 | 1.0 | | 0.5 | | Remarks 14 |

ANO.: Alloy Nos. According to the Present Invention

Remarks 1: The matrix-forming powders contain nickel in an amount less the lower limit thereof.

Remarks 2: The hard phase-forming powders are added in their lower limit amount.

Remarks 3: The hard phase-forming powders contain chromium in its lower limit amount.

Remarks 4: The hard phase-forming powders contain molybdenum in its lower limit amount.

Remarks 5: Graphite powders are added in their lower limit amount.

Remarks 6: Impregnated with acrylic resin.

Remarks 7: Impregnated with lead.

Remarks 8: MnS powders are added in their upper limit amount.

Remarks 9: Graphite powders are added in their upper limit amount.

Remarks 10: The hard phase-forming powders contain vanadium in its upper limit amount.

Remarks 11: The hard phase-forming powders contain molybdenum in its upper limit amount.

Remarks 12: The hard phase-forming powders contain chromium in its upper limit amount.

Remarks 13: The hard phase-forming powders are added in their upper limit amount.

Remarks 14: The matrix-forming powders contain nickel in its upper limit.

Set out in Table 4 are the components in % by weight of comparative alloys 1 to 11.

Remarks 1: The matrix-forming powders contain nickel in an amount less than its lower limit.

Remarks 2: The matrix-forming powders contain nickel in an amount exceeding its upper limit.

Remarks 3: The hard phase-forming powders contain chromium in an amount less than its lower limit.

Remarks 4: The hard phase-forming powders contain chromium in an amount exceeding its upper limit.

Remarks 5: The hard phase-forming powders contain molybdenum in an amount exceeding its upper limit.

Remarks 6: The hard phase-forming powders contain vanadium in an amount exceeding its upper limit.

Remarks 7: The hard phase-forming powders are added in an amount less than its lower limit.

Remarks 8: The hard phase-forming powders are added in an amount exceeding its upper limit.

Remarks 9: Graphite powders are added in an amount less than their lower limit.

Remarks 10: Graphite powders are added in an amount exceeding their upper limit.

Remarks 11: MnS powders are added in an amount exceeding their upper limit.

Set out in Table 5 are the components in % by weight of comparative alloys 12 and 13.

TABLE 4

| Comparative alloy No. | Components in % by weight: Matrix-forming alloy powders: Powder Nos. | Matrix-forming alloy powders: Wt. % | Hard phase-forming powders: Powder Nos. | Hard phase-forming powders: Wt. % | Amount of graphite added wt. % | Amount of MnS powders added wt. % | Amount of forming lubricant added wt. % | Remarks |
|---|---|---|---|---|---|---|---|---|
| 1 | 7 | 89.00 | 9 | 10.00 | 1.00 | | 0.50 | Remarks 1 |
| 2 | 8 | 89.00 | 9 | 10.00 | 1.00 | | 0.50 | Remarks 2 |
| 3 | 2 | 89.00 | 21 | 10.00 | 1.00 | | 0.50 | Remarks 3 |
| 4 | 2 | 89.00 | 22 | 10.00 | 1.00 | | 0.50 | Remarks 4 |
| 5 | 2 | 89.00 | 23 | 10.00 | 1.00 | | 0.50 | Remarks 5 |
| 6 | 2 | 89.00 | 24 | 10.00 | 1.00 | | 0.50 | Remarks 6 |
| 7 | 2 | 99.00 | | | 1.00 | | 0.50 | Remarks 7 |
| 8 | 2 | 69.00 | 9 | 30.00 | 1.00 | | 0.50 | Remarks 8 |
| 9 | 2 | 89.70 | 9 | 10.00 | 0.30 | | 0.50 | Remarks 9 |
| 10 | 2 | 88.30 | 9 | 10.00 | 1.70 | | 0.50 | Remarks 10 |
| 11 | 2 | 86.50 | 9 | 10.00 | 1.00 | 2.50 | 0.50 | Remarks 11 |

TABLE 5

| Comparative alloy No. | Components in % by weight | | | | | | | | Remarks |
|---|---|---|---|---|---|---|---|---|---|
| | A | B | C | D | E | | F | G | |
| | | | | | Powder Nos. | Wt. % | | | |
| 12 | 86.77 | 1.78 | 0.45 | | 9 | 10.00 | 1.00 | 0.50 | Remarks 1 |
| 13 | | | | 99.20 | | | 0.80 | 0.80 | Remarks 2 |

A: Amount of pure iron powders added in % by weight

B: Amount of nickel powders added in % by weight

C: Amount of molybdenum powders added in % by weight

D: Amount of Fe-6.5Co-1.5Ni-1.5Mo alloy powders added in 20 % by weight

E: Amount of the hard phase-forming powders

F: Amount of graphite powders added in % by weight

G: Amount of forming lubricant added in % by weight

Remarks 1: Pure powders+Hard phase-forming powders

Remarks 2: Conventional alloy (U.S. Pat. No. 1,043,124 alloy)

Set out in Table 6 are the general compositions of inventive alloys 1 to 39.

ANO.: Alloy Nos. According to the Present Invention

Remarks 1: The nickel content of the matrix-forming powders is less than its lower limit.

Remarks 2: The hard phase-forming powders are added in their lower limit amount.

Remarks 3: The hard phase-forming powders contain chromium in its lower limit amount.

Remarks 4: The hard phase-forming powders contain molybdenum its lower limit amount.

Remarks 5: Graphite powders are added in their lower limit amount.

Remarks 6: Impregnated with acrylic resin.

Remarks 7: Impregnated with lead.

Remarks 8: MnS powders are added in their upper limit amount.

TABLE 6

| A No. | Components in % by weight | | | | | | | | Remarks |
|---|---|---|---|---|---|---|---|---|---|
| | Fe | Ni | Mo | Cr | V | W | C | MnS | |
| 1 | 96.18 | 0.89 | 0.55 | 1.20 | 0.05 | | 1.14 | | Remarks 1 |
| 2 | 96.15 | 1.92 | 0.51 | 0.36 | 0.02 | | 1.04 | | Remarks 2 |
| 3 | 96.09 | 1.78 | 0.55 | 0.40 | 0.05 | | 1.14 | | Remarks 3 |
| 4 | 95.99 | 1.78 | 0.55 | 0.50 | 0.05 | | 1.14 | | |
| 5 | 95.69 | 1.78 | 0.55 | 0.80 | 0.05 | | 1.14 | | |
| 6 | 95.44 | 1.78 | 0.45 | 1.20 | | | 1.14 | | |
| 7 | 95.41 | 1.78 | 0.48 | 1.20 | | | 1.14 | | Remarks 4 |
| 8 | 95.38 | 1.78 | 0.51 | 1.20 | | | 1.14 | | |
| 9 | 95.34 | 1.78 | 0.55 | 1.20 | | | 1.14 | | |
| 10 | 95.32 | 1.78 | 0.55 | 1.20 | 0.02 | | 1.14 | | |
| 11 | 95.77 | 1.79 | 0.55 | 1.20 | 0.05 | | 0.64 | | Remarks 5 |
| 12 | 95.48 | 1.78 | 0.55 | 1.20 | 0.05 | | 0.94 | | |
| 13 | 95.29 | 1.78 | 0.55 | 1.20 | 0.05 | | 1.14 | | |
| 14 | 95.29 | 1.78 | 0.55 | 1.20 | 0.05 | | 1.14 | | Remarks 6 |
| 15 | 95.29 | 1.78 | 0.55 | 1.20 | 0.05 | | 1.14 | | Remarks 7 |
| 16 | 95.09 | 1.78 | 0.54 | 1.20 | 0.05 | | 1.14 | 0.20 | |
| 17 | 94.51 | 1.76 | 0.54 | 1.20 | 0.05 | | 1.14 | 0.80 | |
| 18 | 93.92 | 1.75 | 0.54 | 1.20 | 0.05 | | 1.14 | 1.40 | |
| 19 | 93.34 | 1.74 | 0.54 | 1.20 | 0.05 | | 1.14 | 2.00 | Remarks 8 |
| 20 | 95.09 | 1.78 | 0.54 | 1.20 | 0.05 | | 1.34 | | |
| 21 | 94.90 | 1.77 | 0.54 | 1.20 | 0.05 | | 1.54 | | Remarks 9 |
| 22 | 95.09 | 1.78 | 0.55 | 1.20 | 0.05 | 0.20 | 1.14 | | |
| 23 | 95.24 | 1.78 | 0.55 | 1.20 | 0.10 | | 1.14 | | |
| 24 | 95.19 | 1.78 | 0.55 | 1.20 | 0.15 | | 1.14 | | |
| 25 | 95.14 | 1.78 | 0.55 | 1.20 | 0.20 | | 1.14 | | |
| 26 | 95.12 | 1.78 | 0.55 | 1.20 | 0.22 | | 1.14 | | Remarks 10 |
| 27 | 95.24 | 1.78 | 0.65 | 1.20 | | | 1.14 | | |
| 28 | 95.14 | 1.78 | 0.75 | 1.20 | | | 1.14 | | Remarks 11 |
| 29 | 94.99 | 1.78 | 0.55 | 1.50 | 0.05 | | 1.14 | | |
| 30 | 94.49 | 1.78 | 0.55 | 2.00 | 0.05 | | 1.14 | | |
| 31 | 94.19 | 1.78 | 0.55 | 2.30 | 0.05 | | 1.14 | | |
| 32 | 93.99 | 1.78 | 0.55 | 2.50 | 0.05 | | 1.14 | | Remarks 12 |
| 33 | 94.67 | 1.68 | 0.57 | 1.80 | 0.08 | | 1.21 | | |
| 34 | 94.05 | 1.58 | 0.60 | 2.40 | 0.10 | | 1.28 | | |
| 35 | 93.43 | 1.48 | 0.62 | 3.00 | 0.13 | | 1.35 | | Remarks 13 |
| 36 | 94.40 | 2.67 | 0.55 | 1.20 | 0.05 | | 1.14 | | |
| 37 | 93.51 | 3.56 | 0.55 | 1.20 | 0.05 | | 1.14 | | |
| 38 | 92.62 | 4.45 | 0.55 | 1.20 | 0.05 | | 1.14 | | |
| 39 | 91.73 | 5.34 | 0.55 | 1.20 | 0.05 | | 1.14 | | Remarks 13 |

Remarks 9: Graphite powders are added in their upper limit amount.

Remarks 10: The hard phase-forming powders contain vanadium in its upper limit amount.

Remarks 11: The hard phase-forming powders contain molybdenum in its upper limit amount.

Remarks 12: The hard phase-forming powders contain chromium in its upper limit amount.

Remarks 13: The hard phase-forming powders are added in their upper limit amount.

Remarks 14: The matrix-forming alloy powders contain nickel its upper limit amount.

Set out in Table 7 are the general compositions of comparative alloys 1–13.

In Tables 3, 4, and 7–8 the matrix-forming alloy powders are referred to as the matrix-forming powders for reasons of space.

In the wear resistance testing, a sintered alloy formed into valve sheet shape was fitted under pressure in an aluminum alloy housing. Then, vertical piston motion was applied to a valve by the rotation of an eccentric cam caused by driving a motor so that the face and sheet planes of the valve were repeatedly collided with the valve seat for a certain period of time, thereby making estimation of the weight lost from both the valve seat and the valve. During the test, temperature control was done by heating the umbrella of the valve. In this test, the eccentric cam was rotated at 3,000 rpm, the portion of the valve sheet to be tested was preset at 250° C. for a repetition time of 10 hours.

TABLE 7

| Comparative | Components in % by weight | | | | | | | | | |
|---|---|---|---|---|---|---|---|---|---|---|
| alloy No. | Fe | Ni | Mo | Cr | V | W | C | MnS | Co | Remarks |
| 1 | 97.07 | | 0.55 | 1.20 | 0.05 | | 1.14 | | | Remarks 1 |
| 2 | 90.84 | 6.23 | 0.55 | 1.20 | 0.05 | | 1.14 | | | Remarks 2 |
| 3 | 96.29 | 1.78 | 0.55 | 0.20 | 0.05 | | 1.14 | | | Remarks 3 |
| 4 | 93.89 | 1.78 | 0.55 | 2.60 | 0.05 | | 1.14 | | | Remarks 4 |
| 5 | 95.10 | 1.78 | 0.79 | 1.20 | | | 1.14 | | | Remarks 5 |
| 6 | 95.09 | 1.78 | 0.55 | 1.20 | 0.25 | | 1.14 | | | Remarks 6 |
| 7 | 96.53 | 1.98 | 0.50 | | | | 1.00 | | | Remarks 7 |
| 8 | 92.81 | 1.38 | 0.65 | 3.60 | 0.15 | | 1.42 | | | Remarks 8 |
| 9 | 95.97 | 1.79 | 0.55 | 1.20 | 0.05 | | 0.44 | | | Remarks 9 |
| 10 | 94.60 | 1.77 | 0.54 | 1.20 | 0.05 | | 1.84 | | | Remarks 10 |
| 11 | 92.85 | 1.73 | 0.53 | 1.20 | 0.05 | | 1.14 | 2.50 | | Remarks 11 |
| 12 | 95.28 | 1.78 | 0.55 | 1.20 | 0.05 | | 1.14 | | | Remarks 12 |
| 13 | 89.78 | 1.49 | 1.49 | | | | 0.80 | | 6.45 | Remarks 13 |

Remarks 1: The matrix-forming powders contain nickel in an amount less than its lower limit.

Remarks 2: The matrix-forming powders contain nickel in an amount more than its upper limit.

Remarks 3: The hard phase-forming powders contain chromium in an amount less than its lower limit.

Remarks 4: The hard phase-forming powders contain chromium in an amount more than its upper limit.

Remarks 5: The hard phase-forming powders contain molybdenum in an amount more than its upper limit.

Remarks 6: The hard phase-forming powders contain vanadium in an amount more than its upper limit.

Remarks 7: The hard phase-forming powders are added in an amount less than their lower limit.

Remarks 8: The hard phase-forming powders are added in an amount more than their upper limit.

Remarks 9: The graphite powders are added in an amount less than their lower limit.

Remarks 10: The graphite powders are added in an amount more than their upper limit.

Remarks 11: The manganese sulfide powders are added in an amount more than their upper limit.

Remarks 12: Discrete powders+hard phase-forming powders

Remarks 13: Conventional alloy (U.S. Pat. No. 1,043,124 alloy).

The aforesaid sintered alloys were subjected to wear resistance, and machinability tests. The results are all reported in Tables 8 and 9.

In the machinability test, a bench drill was used to make holes in a specimen due to the weight of its rotating portion plus an additional weight, thereby making estimation of how many holes could be made. In this test, a specimen having a thickness of 5 mm was drilled under a load of 1.8 kg, using a cemented carbide drill of 3 mm in diameter.

The results of estimation of inventive alloys 1 to 39 are reported in Table 8.

TABLE 8

Results of Estimation of Valve Seats, and Valves Formed of the Alloys 1-39 of the present invention

| | What is estimated | | | | |
|---|---|---|---|---|---|
| | Number of holes by | | | | |
| | Abrasion by Wearing Tests | | | Simple | |
| A No. | Valve seats μm | Valves μm | Total μm | Machinability Tests | Remarks |
| 1 | 148 | 12 | 160 | 8 | Remarks 1 |
| 2 | 163 | 12 | 175 | 12 | Remarks 2 |
| 3 | 15G | 13 | 169 | 11 | Remarks 3 |
| 4 | 153 | 13 | 166 | 9 | |
| 5 | 146 | 14 | 160 | 6 | |
| 6 | 178 | 10 | 188 | 12 | |
| 7 | 169 | 10 | 179 | 7 | Remarks 4 |
| 8 | 168 | 12 | 180 | 9 | |
| 9 | 165 | 12 | 177 | 5 | |
| 10 | 145 | 14 | 159 | 8 | |
| 11 | 153 | 12 | 165 | 7 | Remarks 5 |
| 12 | 149 | 14 | 163 | 6 | |
| 13 | 142 | 15 | 157 | 5 | |

TABLE 8-continued

Results of Estimation of Valve Seats, and Valves Formed of the Alloys 1-39 of the present invention

| | What is estimated | | | | |
|---|---|---|---|---|---|
| | Number of holes by | | | | |
| | Abrasion by Wearing Tests | | | Simple | |
| A No. | Valve seats μm | Valves μm | Total μm | Machinability Tests | Remarks |
| 14 | 141 | 14 | 155 | 23 | Remarks 6 |
| 15 | 138 | 13 | 151 | 19 | Remarks 7 |
| 16 | 146 | 14 | 160 | 9 | |
| 17 | 149 | 17 | 166 | 11 | |
| 18 | 155 | 16 | 171 | 13 | |
| 19 | 158 | 18 | 176 | 15 | Remarks 8 |
| 20 | 138 | 17 | 151 | 3 | |
| 21 | 141 | 21 | 162 | 1 | Remarks 9 |
| 22 | 134 | 17 | 151 | 1 | |
| 23 | 137 | 14 | 151 | 1 | |
| 24 | 130 | 16 | 146 | 1 | |
| 25 | 134 | 16 | 150 | 1 | |
| 26 | 137 | 20 | 157 | 1 | Remarks 10 |
| 27 | 152 | 15 | 167 | 8 | |
| 28 | 147 | 18 | 165 | 8 | Remarks 11 |
| 29 | 140 | 14 | 154 | 3 | |
| 30 | 137 | 16 | 153 | 1 | |
| 31 | 141 | 18 | 159 | 0 | |
| 32 | 144 | 20 | 164 | 0 | Remarks 12 |
| 33 | 138 | 16 | 154 | 2 | |
| 34 | 145 | 15 | 160 | 1 | |
| 35 | 148 | 19 | 167 | 0 | Remarks 13 |
| 36 | 132 | 14 | 146 | 3 | |
| 37 | 133 | 15 | 148 | 3 | |
| 38 | 136 | 17 | 153 | 2 | |
| 39 | 142 | 16 | 158 | 1 | Remarks 14 |

Remarks 1: The matrix-forming powders nickel in an amount less than their lower limit.

Remarks 2: The hard phase-forming powders are added in their lower limit amount.

Remarks 3: The hard phase-forming powders contain chromium in its lower limit amount.

Remarks 4: The hard phase-forming powders contain molybdenum in its lower limit amount.

Remarks 5: The graphite powders are added in their lower limit amount.

Remarks 6: Impregnated with acrylic resin.

Remarks 7: Impregnated with lead.

Remarks 8: The manganese sulfide powders are added in their upper limit amount.

Remarks 9: The graphite powders are added in their upper limit amount.

Remarks 10: The hard phase-forming powders contain vanadium in its upper limit amount.

Remarks 11: The hard phase-forming powders contain molybdenum in its upper limit amount.

Remarks 12: The hard phase-forming powders contain chromium in its upper limit amount.

Remarks 13: The hard phase-forming powders are added in their upper limit amount.

Remarks 14: The matrix-forming powders contain nickel in its upper limit amount.

The results of estimation of comparative alloys 1–13 are set out in Table 9.

TABLE 9

Results of Estimation of Valve Seats, and Valves Formed of Comparative Alloys 1–13

| | What is estimated | | | | |
|---|---|---|---|---|---|
| | Abrasion by Wearing Tests | | | Number of holes by Simple | |
| Comparative alloy No. | Valve seats μm | Valves μm | Total μm | Machinability Tests | Remarks |
| 1 | 203 | 10 | 213 | 16 | Remarks 1 |
| 2 | 168 | 32 | 200 | 1 | Remarks 2 |
| 3 | 184 | 10 | 194 | 16 | Remarks 3 |
| 4 | 162 | 43 | 205 | 00 | Remarks 4 |
| 5 | 102 | 38 | 200 | 8 | Remarks 5 |
| 6 | 162 | 41 | 203 | 1 | Remarks 6 |
| 7 | 230 | 8 | 238 | 50 | Remarks 7 |
| 8 | 170 | 39 | 209 | 0 | Remarks 8 |
| 9 | 189 | 8 | 197 | 10 | Remarks 9 |
| 10 | 165 | 40 | 205 | 0 | Remarks |
| 11 | 174 | 29 | 203 | 16 | Remarks 11 |
| 13 | 180 | 18 | 198 | 8 | Remarks 13 |

Remarks 1: The matrix-forming powders contain nickel in an amount less than its lower limit.

Remarks 2: The matrix-forming powders contain nickel in an amount more than its upper limit.

Remarks 3: The hard phase-forming powders contain chromium in an amount less than its lower limit.

Remarks 4: The hard phase-forming powders contain chromium in an amount more than its upper limit.

Remarks 5: The hard phase-forming powders contain molybdenum in an amount more than its upper limit.

Remarks 6: The hard phase-forming powders contain vanadium in an amount more than its upper limit.

Remarks 7: The hard phase-forming powders are added in an amount less than their lower limit.

Remarks 8: The hard phase-forming powders are added in an amount more than their upper limit.

Remarks 9: The graphite powders are added in an amount less than their lower limit.

Remarks 10: The graphite powders are added in an amount more than their upper limit.

Remarks 11: The manganese sulfide powders are added in an amount more than their upper limit.

Remarks 12: Discrete Powders+Hard Phase-Forming Powders

Remarks 13: Conventional alloy (U.S. Pat. No. 1,043,124 alloy) From Tables 8 and 9, the following are found. In FIGS. 2 to 8, triangular, cross, and square plots indicate the abrasion of valves, the abrasion of valve seats, and the total abrasion of the valves and valve seats. In these figures, the total abrasion of the valve and valve seat made from a conventional alloy (Comparison 13) is also indicated. It is here to be noted that inventive alloy 1 and comparative alloy 1, for instance, are referred to as Invention 1 and Comparison 1.

Examination was made of what occurred with the alloys 1, 13, and 36–39 according to the present invention, and comparative alloys 1–2, when the amount of nickel in the matrix-forming alloy powders was varied.

Figure 2:
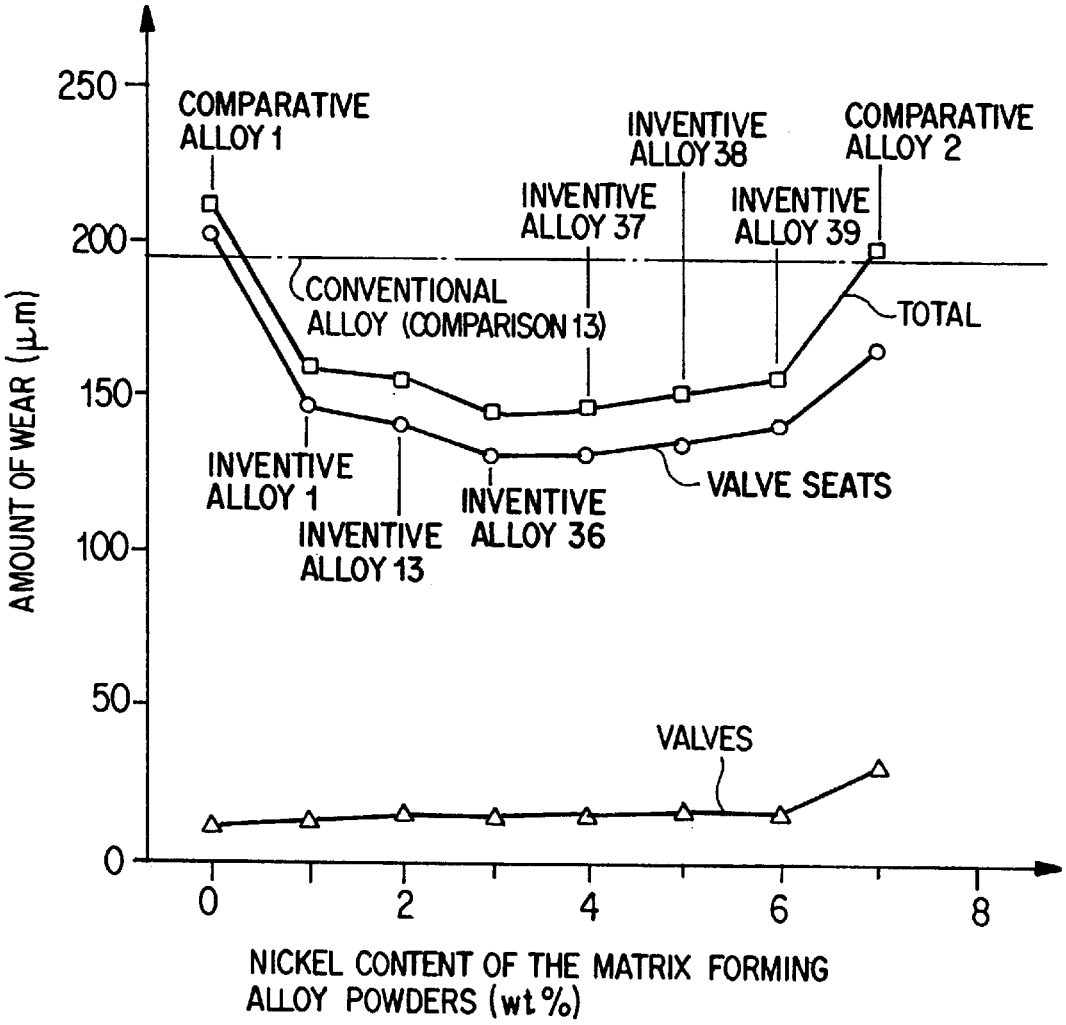
FIG. 2 is a graph showing the results of estimation of the abrasion of some exemplary wear-resistant sintered alloys when the nickel content of the matrix-forming alloy powders are varied.

As the nickel forms a solid solution with the matrix-forming alloy powders, the abrasion of the valve seats decreases as can be seen from FIG. 2. If the nickel content of the matrix-forming alloy powders lies within the range of 1 to 6%, then the valve seats show a stable yet low abrasion. At a content exceeding 6%, on the contrary, the abrasion of the valve seats becomes large. On the other hand, the abrasion of the valves remains substantially Constant, if the nickel content of the matrix-forming alloy powders is up to 6%, but it again becomes large at a content more than 6%. In other words, the total abrasion is kept low at a nickel content of 1 to 6%, but becomes abruptly large at more than 6%.

As mentioned above, if the nickel content of the matrix-forming alloy powders is up to 6%, an enhanced effect on the reinforcement of the matrix and, hence, improvements in wear resistance is achievable due to a nickel content increase. At a nickel content exceeding 6%, however, it is believed that the abrasion of the valve seats increases for the reason that the strength of the matrices becomes low due to an increased hardness of the matrix-forming alloy powders and a drop of the compressibility of the powders, and that powders occurring from the matrices reinforced by nickel behave as wearing particles to cause the valves to wear away, resulting in an abruptly increased total abrasion. Thus, it is found that the nickel, when contained in the matrix-forming alloy powders in an amount of 1 to 6%, is especially effective for wear resistance.

Figure 3:
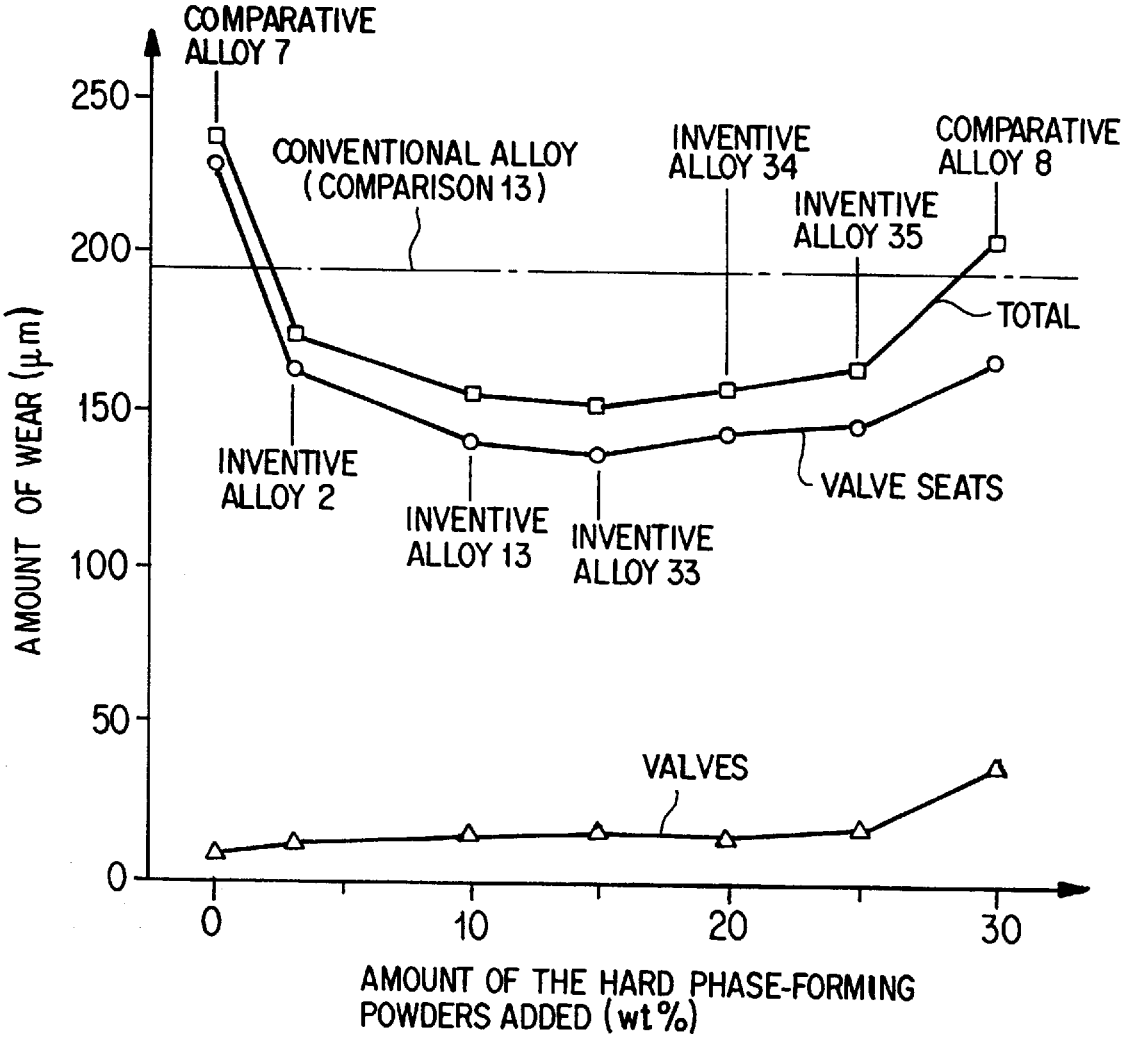
FIG. 3 is a graph showing the results of estimation of abrasion when the amount of the hard phase-forming powders added is varied.

From comparisons of the alloys 2, 13, and 33–35 according to the present invention with comparative alloys 7 and 8, it is found that if the hard phase-forming powders are used in an amount of 3%, the abrasion of the valve seats is much more reduced than that of the valve seats free from them, as can be seen from FIG. 3, and that as the amount of the hard phase-forming powders added increases up to 15%, the abrasion of the valve seats decreases gradually, but it increases gradually as 15% is exceeded. The abrasion of the valves, on the other hand, tends to increase slowly if the amount of the hard phase-forming powders added is up to 25%, but it increases when exceeding 25%. It is thus found that the total abrasion of the valves and valve seats shows a stable yet low value if the amount of the hard phase-forming powders lies within the range of 3 to 25%, but it increases sharply as 25% is exceeded.

This indicates that as the chromium content of the hard phase-forming powders added increases, the wear resistance of the valve seats increases on account of an increase in the amount of the carbide forming the hard phase, improvements in the hardenability of the matrices because of the diffusion of chromium into the hard phase-forming powders, and an effect of the soft ferrite phase formed around the hard phase upon absorbing shocks upon the valves received on the valve seats. Concurrently with an increase in the chromium content, however, the valve seats make an increased attack on the valves due to the chromium carbide and intermetallic compounds. Upon exceeding 25%, however, it is believed that the abrasion of the valves increases due to an increased attack thereon, and powders occurring from the valves act on the valve seats with an increased ferrite as wearing particles, and so the valve seats wear away, too, resulting in a sharp increase in the total abrasion of the valves and valve seats. It is thus found that the hard phase-forming powders, if added in the range of 3 to 25%, are particularly effective for wear resistance.

Figure 4:
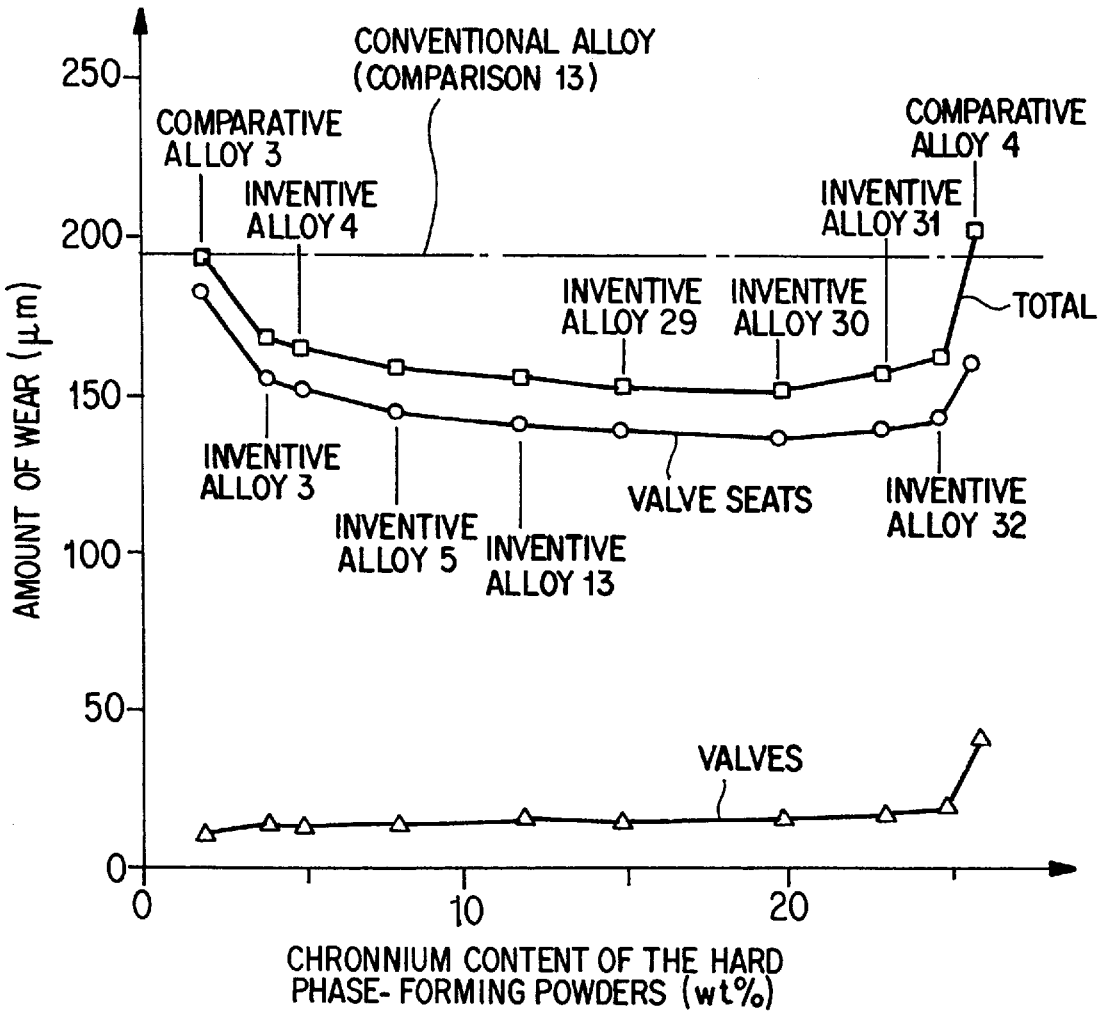
FIG. 4 is a graph showing the results of estimation of abrasion when the chromium content of the hard phase-forming powders is varied.

From comparison of the alloys 3–5, 13, and 29–32 according to the present invention with comparative alloys 3 and 4, it is found that if the chromium content of the hard phase-forming alloys lies within the range of 4% to 25%, as shown in FIG. 4, the valve seats show a reduced yet stable and constant abrasion, but they show an increased abrasion upon exceeding 25%.

If the chromium content of the hard phase-forming powders is up to 25%, on the other hand, the valves show a stable abrasion, but exhibit a sharply increased abrasion upon exceeding 25%. It is thus found that the total abrasion of the valves and valve seats has a stable value at 4 to 25%, but increases sharply upon exceeding 25%.

This indicates that as the amount of the hard phase-forming powders added increases to 15%, the wear resistance of the valve seats increases due to an increase in the amount of the hard phase formed by chromium carbides and intermetallic compounds, improvements in the hardenability of the matrices because of the diffusion of chromium into the hard phase-forming powders, and an effect of the soft ferrite phase formed around the hard phase on absorbing shocks upon the valves received on the valve seats. Concurrently with an increase in the chromium content, however, the valve seats make an increased attack on the valves due to the chromium carbide and intermetallic compounds, with an increase in the amount of the ferrite phase. Upon exceeding 25%, it is believed that the abrasion of the valves increases sharply due to an increased attack thereon, and that powders occurring from the valves act as abrading particles, resulting in an accelerated wearing of the valve seats having an increased ferrite phase of low strength. It is thus found that the chromium, if contained in the hard phase-forming powders in an amount ranging from 4% to 25%, is particularly effective for wear resistance.

The alloys 6–9, 27 and 28 will now be compared with comparative alloy 5. It is here to be noted that the alloys 6–9, 27 and 28 according to the present invention correspond as a whole to the alloys in claims 1 and 2, the alloy 6 of the present invention corresponds to the alloy in claim 1 wherein the molybdenum content of the hard phase is 0%.

Figure 5:
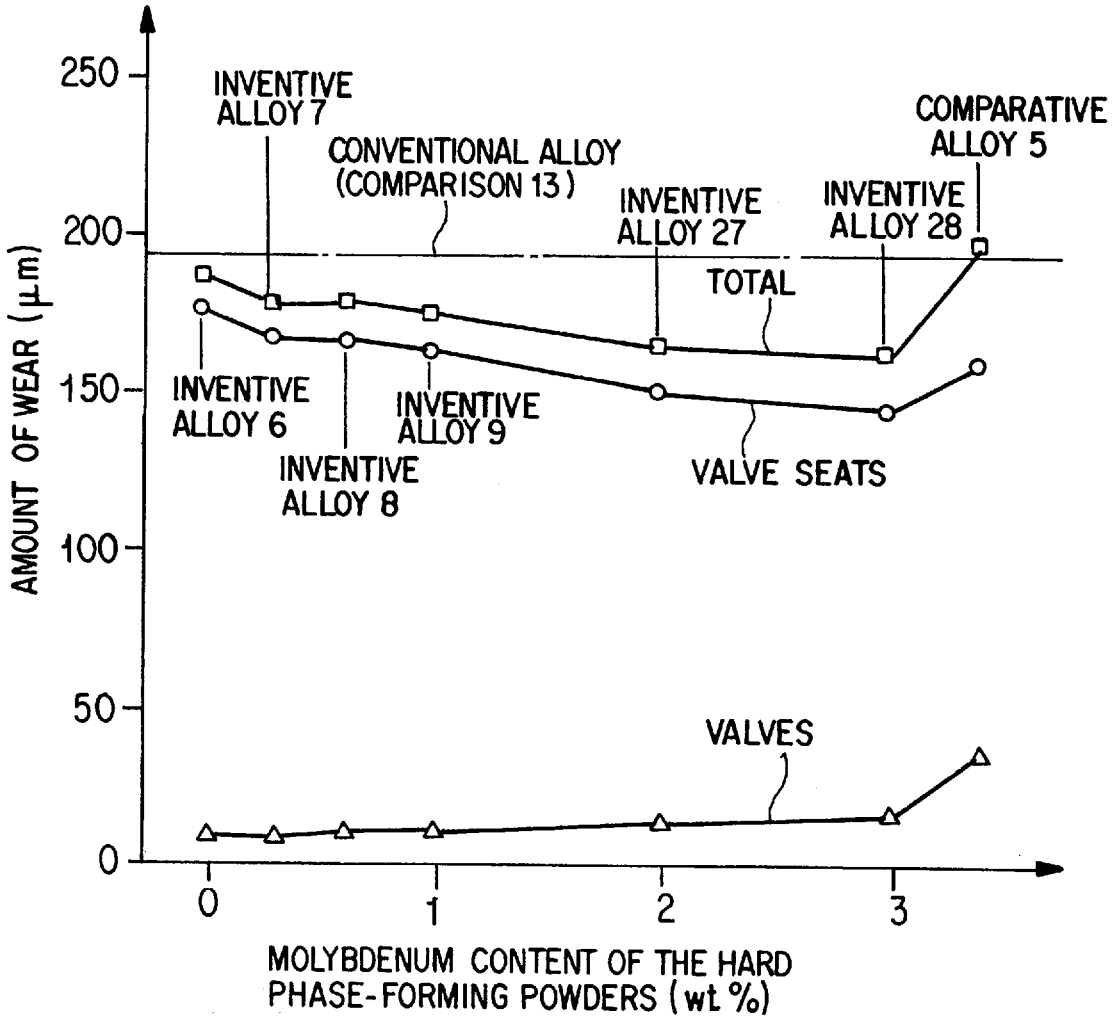
FIG. 5 is a graph showing the results of estimation of abrasion when the molybdenum content of the hard phase-forming powders is varied.

As the molybdenum content of the hard phase-forming powders increases, the amounts of the molybdenum carbide and an eutectic compound with chromium increase, so that the abrasion of the valve seats can decrease, as can be seen from FIG. 5. When a molybdenum content exceeds 3%, however, the abrasion of the valve seats increase. The abrasion of the valves tend to increase gently with an increased attack thereon, but the valves undergo a rapid wearing immediately when the molybdenum content exceeds 3%. It is thus found that even when the hard phase-forming powders do not contain molybdenum at all, the alloys of the present invention are lower in terms of abrasion than a conventional alloy (comparative alloy 13), thus achieving high quality performance. It is also found that the molybdenum, if provided in the form of a solid solution to the hard phase-forming powders in an amount ranging from 0.3% to 3%, is particularly effective for improvements in wear resistance.

The alloys 9, 10, 13, and 23–26 of the present invention will now be compared with comparative alloy 6. It is here to be noted that the alloys 9, 10, 13, and 23–26 of the present invention correspond generally to the alloy in claim 3.

Figure 6:
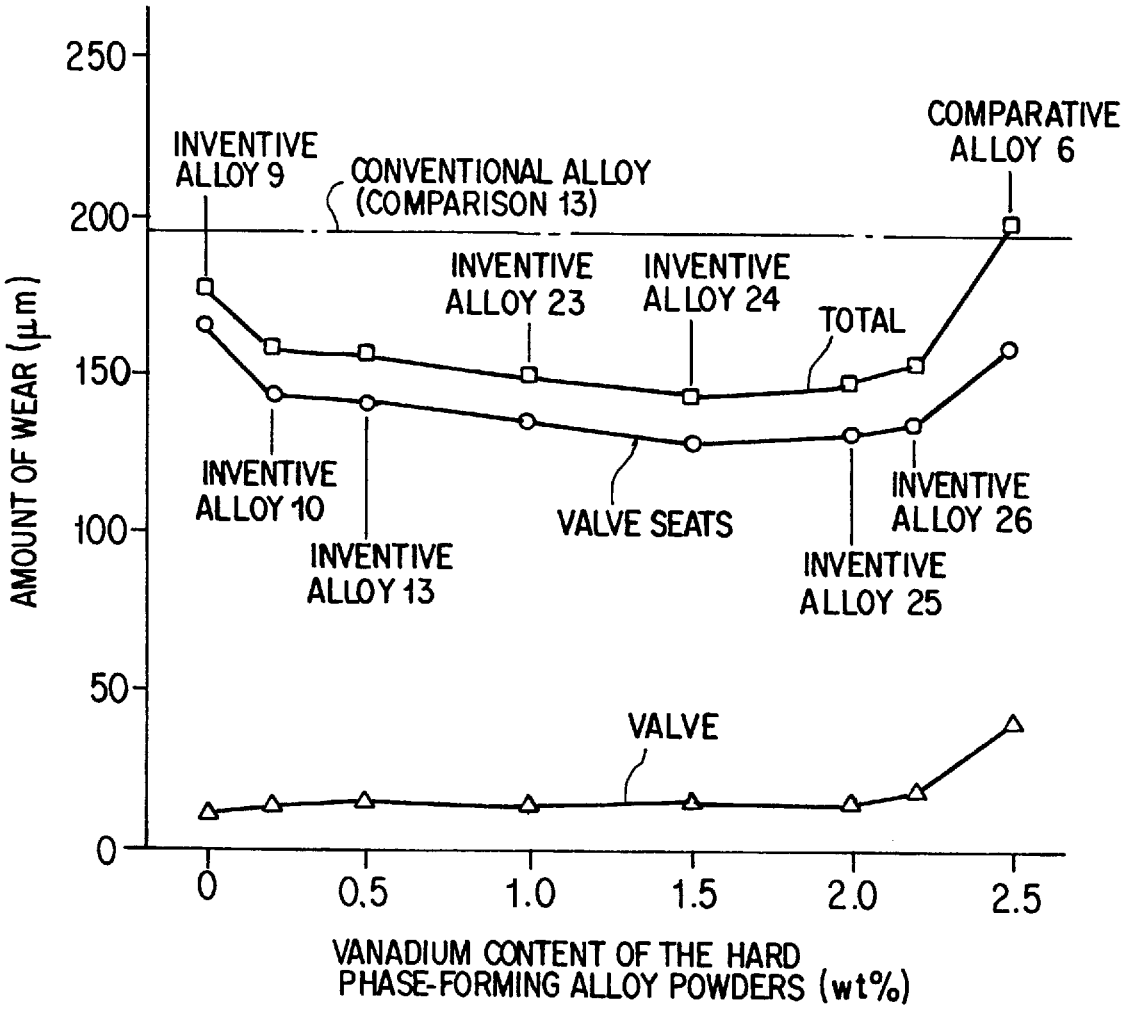
FIG. 6 is a graph showing the results of estimation of abrasion when the vanadium content of the hard phase-forming alloys powders is varied.

The incorporation of 0.2% of vanadium in the hard phase-forming alloys is found to be effective for improvements in wear resistance, because the abrasion of the valve seats can decrease, as can be seen from FIG. 6. When the amount of vanadium exceeds 2.2%, on the other hand, the wearing of the valve seats is rapidly accelerated under the influences of an increased attack on the valves and drop in a strength incidental to a compressibility drops. It is thus found that the vanadium, if contained in the hard phase-forming powders in an amount ranging from 0.2% to 2.2%, is particularly effective for wear resistance.

It is here to be noted that the alloy 22 of the present invention is an alloy containing simultaneously vanadium and tungsten in the hard phase-forming powders. This alloy is found to be effectively improved in terms of wear resistance; that is, a valve made of this alloy increases slightly in abrasion (17 μm) while a valve seat formed of this alloy decreases in abrasion (134 μm), so that the total abrasion thereof can decrease. It is also to be noted that the alloy 22 of the present invention corresponds partly to the alloy in claim 3.

Figure 7:
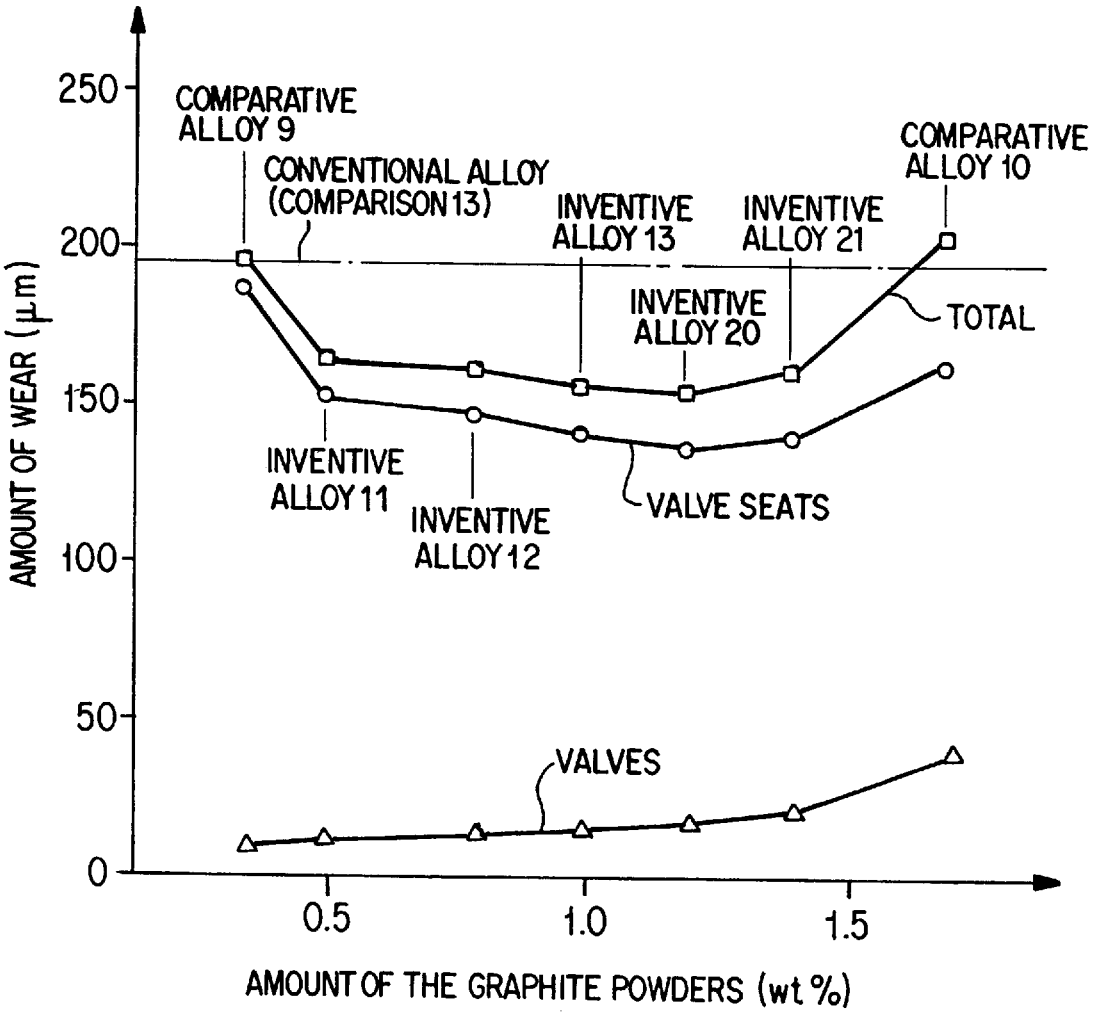
FIG. 7 is a graph showing the results of estimation of abrasion when the amount of the graphite powders is varied.

From comparisons of the alloys 11–13, 20, and 21 of the present invention with comparative alloys 9 and 10, it is found that the abrasion of the valve seats has a decreased yet stable value, if the amount of the graphite powders added lies between 0.3% and 1.2%, as can be seen from FIG. 7, but it increases when the added amount thereof exceeds 1.4%.

On the other hand, the abrasion of the valves increases gently as the amount of the graphite powders added increases, and tends to increase noticeably upon exceeding 1.4%. Thus, the total abrasion of the valves and valve seats has a decreased yet stable value between 0.3% and 1.4%. This is because as the amount of the graphite powders added increases, the matrix structures are reinforced by the carbon provided in the form of a solid solution to the matrices, so making a contribution to improvements in wear resistance. When the amount of the graphite powders added is more than 1.4%, however, it is believed that an unsaturated carbon solid solution gives rise to drop in a matrix strength and, hence, drop in a wear resistance. It is also believed that the matrices, because of being too much reinforced, make a heavier attack on the valves, resulting in an accelerated wearing of the valves, and so the wearing of the valve seats is accelerated as well.

Figure 8:
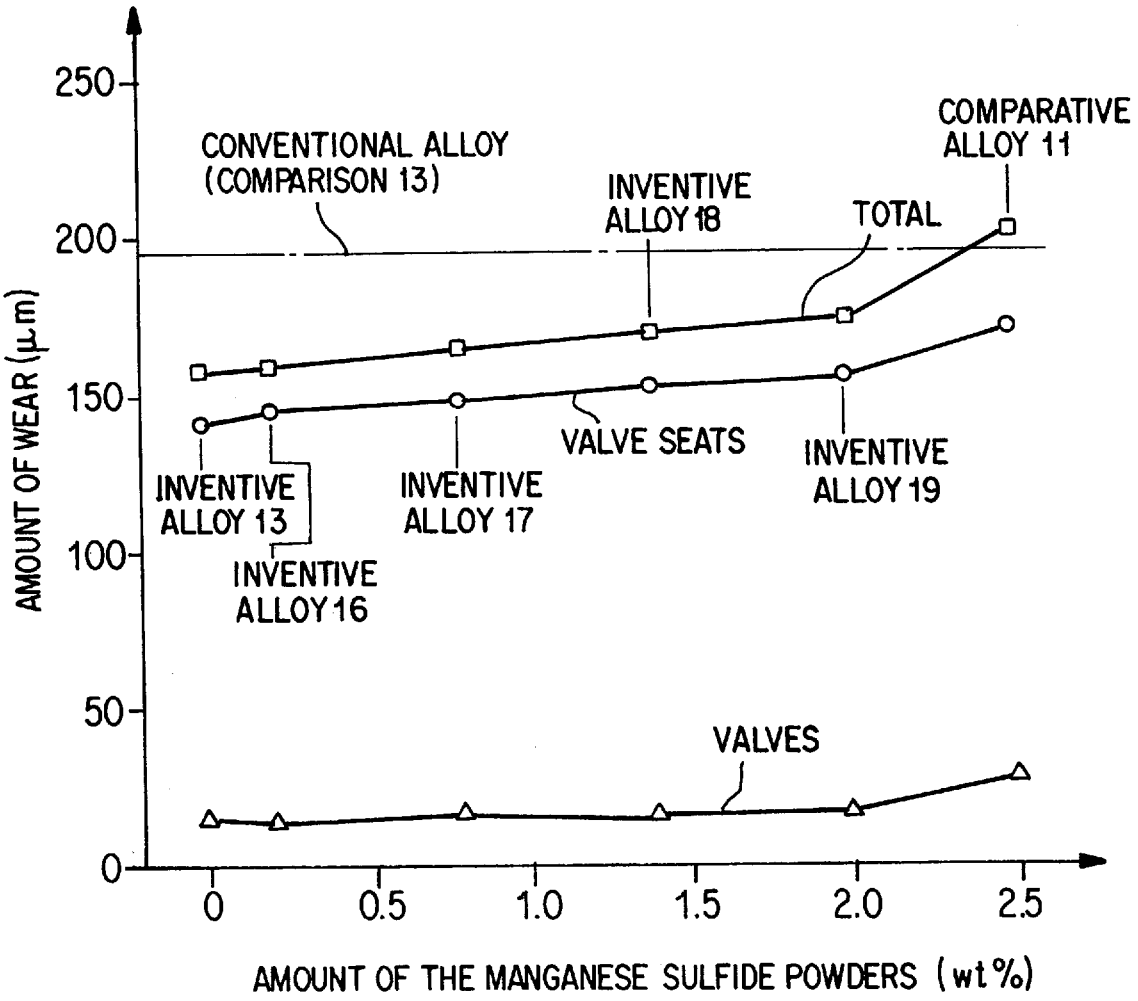
FIG. 8 is a graph showing the results of estimation of abrasion when the amount of the manganese sulfide powders is varied.

From comparisons of the alloys 13, and 16–19 of the present invention with comparative alloy 11, it is found that machinability is improved by the addition of MnS powders, as can be seen from FIG. 8, and the effect on such improvements becomes larger as the amount of the MnS powders added increases.

As the amount of the MnS powders added increases, however, the MnS powders inhibit the promotion of sintering, giving rise to drop in a matrix strength; in other words, the abrasion of the valve seats increases. Upon the amount of the MnS powders added exceeding 2.0%, there is too large a drop in matrix strength, resulting in an increased wearing. If the amount of the MnS powders added is up to 2.0%, the abrasion of the valves has a substantially constant yet stable value, but the abrasion of the valves increases as the wearing of the valve seats proceeds further (see FIG. 8). It is thus found that the addition of the MnS powders is effective for improvements in machinability; however, it is preferable that the amount of the MnS powders added is up to 2.0% because excesive addition of much MnS gives rise to a wear resistance drop.

From comparisons of the alloys 13, 14, and 15 of the present invention with comparative alloy 13, it is found that the alloy 13 of the present invention is more improved in terms of wear resistance (a total abrasion of about 44 μm) than comparative (or conventional) alloy 13, but inferior in terms of machinability thereto. However, it is understood that this can be solved by the impregnation of pores in the the alloy of the present invention with acrylic resin or lead; that is, the machinability of the inventive alloy can be improved over that of comparative (or conventional) alloy 13 without detriment to wear resistance.

The alloy 13 of the present invention will now be compared with comparative alloy 12. Observation of photomicrographs reveals that the alloy (comparative alloy 12), wherein the matrix-forming alloy powders according to the present invention are provided in discrete forms, has a mixed structure of austenite and martensite—the nuclei of which are formed by non-diffusing nickel—dispersed into pearlite, in which mixed structure there are dispersed a ferrite phase containing as a nucleus a hard phase formed by the hard phase-forming powders according to the present invention, and a martensite phase which surrounds that ferrite phase. This alloy is poor in wear resistance due to a high proportion of the pearlite phase having low strength, and machinability as well due to a high proportion of the martensite phase. It is thus seen as preferable that the matrix-forming alloy powders are used in the form of perfect alloy powders, rather than in discrete forms.

As can be appreciated from the foregoing explanation, the present invention successfully provides a wear-resistant sintered alloy which is not only inexpensive owing to the fact that expensive elements such as cobalt is not use, but is also improved in terms of wear resistance and machinability over conventional alloys, and a method of making such a sintered alloy. In particular, the wear-resistant sintered alloy according to the present invention makes it possible to provide valve seats capable of meeting recent low-cost requirements in the automobile industry.

What we claim is:

1. A wear-resistant sintered alloy having a general composition consisting essentially of, in weight ratio, 0.736 to 5.79% of nickel, 0.12 to 6.25% of chromium, 0.294 to 0.965% of molybdenum, and 0.508 to 2.0% of carbon with the balance being iron, and inevitable impurities, and having a micro structure wherein a bainite matrix structure or a mixed bainite and sorbite matrix structure includes a nucleus having a hard phase composed mainly of chromium carbide, and a ferrite surrounding said nucleus and having a high chromium concentration and a martensite surrounding said ferrite are dispersed.

2. A wear-resistant sintered alloy having a general composition consisting essentially of, in weight ratio, 0.736 to 5.79% of nickel, 0.12 to 6.25% of chromium, 0.303 to 1.715% of molybdenum, and 0.508 to 2.0% of carbon with the balance being iron, and inevitable impurities, and having a micro structure wherein a bainite matrix structure or a mixed bainite and sorbite matrix structure includes a nucleus having a hard phase composed mainly of chromium carbide, and a ferrite surrounding said nucleus and having a high chromium concentration and a martensite surrounding said ferrite are dispersed.

3. A wear-resistant sintered alloy having a general composition consisting essentially of, in weight ratio, 0.736 to 5.79% of nickel, 0.12 to 6.25% of chromium, 0.303 to 1.715% of molybdenum, 0.508 to 2.0% of carbon, and 0.006 to 0.55% of vanadium and/or 0.03 to 1.25% of tungsten with the balance being iron, and inevitable impurities, and having a micro structure wherein a bainite matrix structure or a mixed bainite and sorbite matrix structure includes a nucleus having a hard phase composed mainly of chromium carbide, and a ferrite surrounding said nucleus and having a high chromium concentration and a martensite surrounding said ferrite are dispersed.

4. The wear-resistant sintered alloy according to claim 1, in which 0.1 to 2.0% or less by weight of manganese sulfide is homogeneously dispersed.

5. The wear-resistant sintered alloy according to claim 1, wherein any one of an acrylic resin, lead, and a lead alloy is dispersed into pores therein.

6. A method of producing the wear-resistant sintered alloy according to claim 1, comprising:

compacting a powder mixture of (a) 0.5 to 1.4% by weight of a graphite powder and (b) 3 to 25% by weight of a hard phase-forming powder having a composition consisting essentially of, in weight ratio, 4.0 to 25% of chromium, and 0.25 to 2.4% of carbon with the balance being iron, and inevitable impurities with (c) a matrix-forming alloy powder having a composition consisting essentially of, in weight ratio, 1 to 6% of nickel, and 0.4 to 1.0% of molybdenum with the balance being iron, and inevitable impurities into a compacted body and sintering said compacted body to thereby obtain said wear-resistant sintered alloy.

7. A method of producing the wear-resistant sintered alloy according to claim 2, comprising: compacting a powder mixture of (a) 0.5 to 1.4% by weight of a graphite powder and (b) 3 to 25% by weight of a hard phase-forming powder having a composition consisting essentially of, in weight ratio, 4.0 to 25% of chromium, 0.3 to 3.0% of molybdenum, and 0.25 to 2.4% of carbon with the balance being iron, and inevitable impurities with (c) a matrix-forming alloy powder having a composition consisting essentially of, in weight ratio, 1 to 6% of nickel, and 0.4 to 1.0% of molybdenum with the balance being iron, and inevitable impurities into a compact body and sintering said compacted body to thereby obtain said wear-resistant sintered alloy.

8. A method of producing the wear-resistant sintered alloy according to claim 3, comprising: compacting a powder mixture of (a) 0.5 to 1.4% by weight of a graphite powder and (b) 3 to 25% by weight of a hard phase-forming powder having a composition consisting essentially of, in weight ratio, 4.0 to 25% of chromium, 0.3 to 3.0% of molybdenum, 0.25 to 2.4% of carbon, and 0.2 to 2.2% of vanadium and/or 1.0 to 5.0% of tungsten with the balance being iron, and inevitable impurities with (c) a matrix-forming alloy powder having a composition consisting essentially of, in weight ratio, 1 to 6% of nickel, and 0.4 to 1.0% of molybdenum with the balance being iron, and inevitable impurities into a compacted body and sintering said compacted body to thereby obtain said wear-resistant sintered alloy.

9. A method of producing the wear-resistant sintered alloy according to any one of claims 6–8, wherein 0.1 to 2.0% by weight of a manganese sulfide powder is further mixed with the powder mixture to thereby homogeneously disperse 2% or less by weight of manganese sulfide in said wear-resistant alloy.

10. A method of producing the wear-resistant sintered alloy according to any one of claims 6–8, further comprising impregnating or infiltracting any one of an acrylic resin, lead, and a lead alloy into pores in the sintered body obtained by compacting and sintering the powder mixture.

11. The wear-resistant sintered alloy according to claim 2, in which 0.1 to 2.0% or less by weight of manganese sulfide is homogeneously dispersed.

12. The wear-resistant sintered alloy according to claim 3, in which 0.1 to 2.0% or less by weight of manganese sulfide is homogeneously dispersed.

13. The wear-resistant sintered alloy according to claim 2, wherein any one of an acrylic resin, lead, and a lead alloy is dispersed into pores therein.

14. The wear-resistant sintered alloy according to claim 3, wherein any one of an acrylic resin, lead, and a lead alloy is dispersed into pores therein.

15. The wear-resistant sintered alloy according to claim 4, wherein any one of an acrylic resin, lead, and a lead alloy is dispersed into pores therein.

16. The wear-resistant sintered alloy according to claim 11, wherein any one of an acrylic resin, lead, and a lead alloy is dispersed into pores therein.

17. The wear-resistant sintered alloy according to claim 12, wherein any one of an acrylic resin, lead, and a lead alloy is dispersed into pores therein.

18. A method of producing the wear-resistant sintered alloy according to claim 9, further comprising impregnating or infiltractign any one of an acrylic resin, lead, and a lead alloy into pores in the sintered body obtained by compacting and sintering the powder mixture.

* * * * *